United States Patent [19]

Bencriscutto

[11] Patent Number: 4,930,786

[45] Date of Patent: Jun. 5, 1990

[54] GOLF CLUB SWING TRAINING DEVICE

[76] Inventor: Michael Bencriscutto, 6121 Golf Ridge Dr., Racine, Wis. 53402

[21] Appl. No.: 341,836

[22] Filed: Apr. 24, 1989

[51] Int. Cl.[5] ..... A63B 69/36

[52] U.S. Cl. ..... 273/186 C; 273/187 A

[58] Field of Search ..... 273/186 R, 196, 186 C, 273/183 A, 183 R, 187 A, 32 R, 32 A, 32 B, 183 E, 186 B

[56] References Cited

U.S. PATENT DOCUMENTS 2,152,381 3/1939 Harpster ..... 273/186 R

FOREIGN PATENT DOCUMENTS 383767 11/1932 United Kingdom ..... 273/196

*Primary Examiner*—George J. Marlo

*Attorney, Agent, or Firm*—Nilles & Nilles

[57] ABSTRACT

A device for training the backswing and downswing of both right- and left-hand golfers is provided having a base member that includes a forward portion, an intermediate interface and a rearward portion. A straight line set of spaced apart vertically extending pylons is mounted on the forward portion to extend to the intermediate interface. A right-hand curved set of spaced apart vertically extending pylons is mounted on the rearward portion to extend rearwardly from the intermediate interface along an inside curved backswing path for a right-hand golfer. A left-hand curved set of spaced apart vertically extending pylons is also mounted on the rearward portion to extend rearwardly from the intermediate interface along an inside curved backswing path for a left-hand golfer.

9 Claims, 1 Drawing Sheet

GOLF CLUB SWING TRAINING DEVICE

BACKGROUND OF THE INVENTION

1. Field of the Invention

The present invention relates to a device to enable a golfer to track and thus train both the backswing and downswing of the head of a golf club and more specifically to a single device universally usable by either right- or left-hand golfers.

2. Description of the Prior Art

It is known that a golfer, in order to prevent slicing the golf club head across the golf ball at time of impact, should cause the club head to follow what is termed an inside-out swing path relative to the desired line-of-flight of the ball and, as will be discussed, there are training devices to assist a golfer to develop such an inside-out swing. The phrase "inside-out" is not quite as accurate as it could be because the center point of contact on the club head should never travel "out" over the line of flight. At the beginning of the backswing the club head should initially follow a straight line parallel to the intended line of flight away from the ball and then the club head should follow a path that curves toward the inside away from the intended line of flight of the golf ball. For accuracy of reference this backswing path will be termed a straight-inside curved backswing path. Similarly during the downswing, the club head first follows the inside curved path and then a straight line through the ball contact zone. After ball contact, the club head should follow through along a swing path that curves back to the inside. Thus the downswing path can be described as an inside-straight-inside swing path. In a correctly executed backswing and downswing, the center point of contact on the golf club head will never pass outside of the intended line of flight of the golf ball.

Existing training devices do not have satisfactory means to assist the golfer to train his or her swing to follow the straight-inside curved backswing path. During the initial phase of the backswing, the golfer should first take the club head back away from the ball in a straight line, in order to cause the golfer to naturally shift his weight onto the rear leg farthest from the target, and then continue the backswing along the inside curved path. If proper weight shift occurs during the backswing, then during the ensuing downswing the golfer will inherently shift his or her weight back from the rear leg to the front leg and cause the club head to follow the desired straight line through the zone of ball contact to prevent slicing across the ball. Prior art training devices do not provide suitable means for training the golfer to initially move the club head back in a straight line during club head take-away when beginning the backswing and such prior training devices as do exist are not universally usable by both right- and left-hand golfers.

One such prior art device is shown in U.S. Pat. No. 2,152,381 issued Mar. 28, 1939 to H. Harpster. This patent discloses a mat having a plurality of yieldable vertically extending vanes arranged to provide only a curved or arcuate barrier adjacent the path the head of the club must travel. This device will encourage the golfer to cause the golf club head to follow an incorrect path in the initial take-away at the beginning of the backswing. The club head will initially be taken away from the ball along a curved path which discourages a proper shifting of weight. This device does not define a straight line barrier offset and extending from the rear of the club head to train the golfer that in the beginning of the backswing he or she should cause the club head to first follow a straight line and then a curved path nor is the device universally usable by both right- and left-hand golfers.

Another prior art device is shown in U.S. Pat. No. 3,125,343 issued Mar. 17, 1964 to S. J. price, Jr. et al. This device provides a solid barricade which will be struck by the club head if it follows an improper outside-in swing path but it does not train the golfer that the club head should follow a straight line in the beginning of the backswing. In one embodiment the barricade does have a straight portion but this straight portion is only located opposite the area in which the ball and club head are placed and does not extend beyond the rear of the club head when placed to address the ball. Because the straight position does not extend beyond the rear of the club head it cannot function to train the golfer that the initial phase of the backswing should follow a straight line. This training aid is not universally usuable by both right- and left-hand golfers and a solid wall tends to intimidate golfers causing them to keep the club head too far away from the wall.

A further prior art device is shown in U.S. Pat. No. 3,350,101 issued Oct. 31, 1967 to F. M. Bishop et al. This patent shows a plurality of swing paths traced on a flat horizontal pad to converge at a simulated golf ball location with one of the swing paths having an initial straight line. This device provides no straight line vertical barrier means that is offset from the toe of the club head and that extends in a straight line beyond the rear of the golf club head nor does the patent instruct the golfer as to which one of the plurality of lines the club head should follow during the initial phase of the backswing. This device is not universally usable by left- and right-hand golfers.

It is also known from U.S. Pat. No. 4,786,057, issued Nov. 22, 1988 to Larry G. Brown, to provide a pivotally mounted vertical target flap behind the golf ball which is pushed down to a horizontal position if the golf club head follows a correct path during the initial phase of the backswing. However, because the toe-to-heel dimension of the club head is three to four inches wide, the head will sweep a wide path and will push the pin to the horizontal position even if the initial backswing follows an improper nonstraight path.

SUMMARY OF THE INVENTION

Accordingly, it is the general purpose of this invention to provide a single golf swing training aid that will assist both right- and left-hand golfers in training the backswing to initially follow a straight-inside curved swing path.

It is another object of the invention to provide a universal device that can be used without modification by both right- and left-hand golfers, is simple in design, easy to carry on the golf course and can be instantly placed alongside a golf ball during training rounds of play.

These and other objects are accomplished by providing a device comprising a horizontal base member having a line-of-flight axis that will be parallel to the actual line of flight of the ball when the device is in use. The base member includes: a forward portion having a front end and an intermediate interface; and a rearward portion extending rearwardly from the interface and terminating in a back end. A plurality of space apart, vertically extending, yieldable pylons are mounted on the forward portion to extend in a straight line from the front end parallel to the line-of-flight axis back to the interface for a distance that will provide a straight line set of pylons that extends rearwardly from a region offset from the toe of the golf club head placed to address the ball when the device is in position for use to define an offset straight line vertical swing path barrier behind the club head. A right-hand curved set of spaced apart, vertically extending, yieldable pylons are mounted on the rearward portion, starting at the intermediate interface, to extend along a curved line that flares smoothly outward away from the line-of-flight axis to the back end to define a first vertical curved swing path barrier for right-hand golfers. A left-hand curved set of spaced apart, vertically extending, yeildable pylons are also mounted on the rearward portion, starting at the interface, to extend along a curved line that flares smoothly outward away from the line-of-flight axis and the right-hand set of pylons to define a second vertical curved swing path barrier for left-hand golfers. The pylons can be removably mounted in suitable correspondingly located apertures in the forward and rearward portions.

Preferably the forward portion will be narrow and have spaced apart, straight edges extending parallel to the line-of-flight axis and to each other from the front end to the intermediate interface to define horizontal straight line swing path edges for right- and left-hand golfers, respectively. Similarly the rearward portion preferably will have a right-hand edge flaring smoothly outward from the interface away from the line-of-flight axis and spaced equidistant from the right-hand set of pylons and their associated apertures to provide a horizontal inside curved swing path edge for right-hand golfers; and a left-hand edge flaring smoothly outward from the interface away from the line-of-flight axis and spaced equidistant from the left-hand set of pylons and their associated apertures to provide a horizontal inside curved swing path edge for left-hand golfers.

The forward portion may be provided with golf ball position indexes starting adjacent the front end and spaced apart from each other along the line-of-flight axis to indicate where the device should be placed relative to a golf ball depending upon whether a driver, fairway wood, or iron is to be used.

In use the pylons define vertical swing path barriers and the guide edges define a horizontal swing path edge and these coact to form separate vertical and horizontal references visually alignable relative to the toe of the golf club by the golfer to train both right- and left-hand golfers so that during the initial phase of the backswing, they will first move the head of the golf club away from the ball in a straight line and then along an inside curved path.

DESCRIPTION OF THE PREFERRED EMBODIMENT

Figure 1:
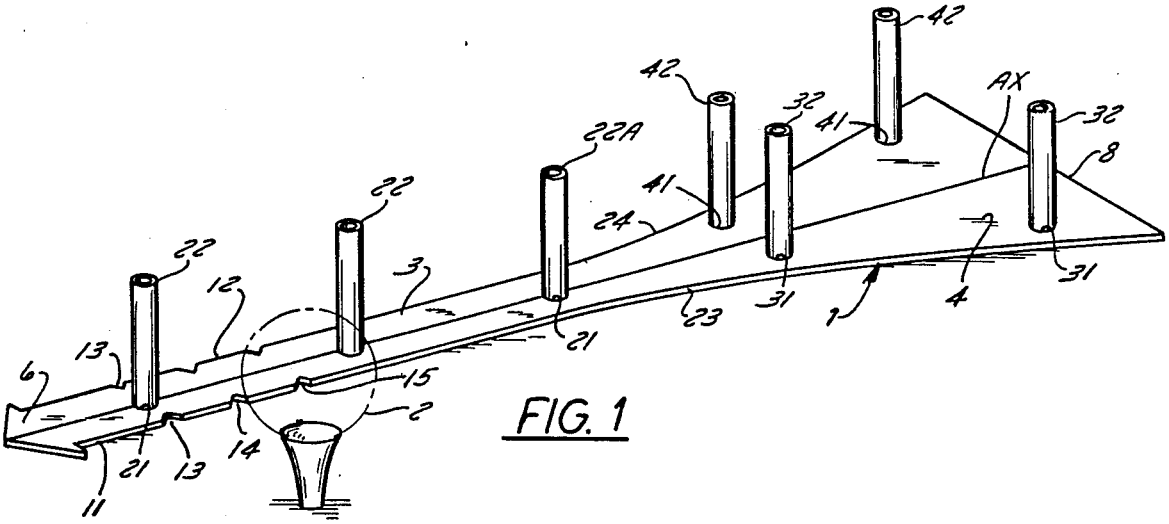
FIG. 1 is a perspective view of the device positioned adjacent a golf ball for use by a right-hand golfer.
Figure 2:
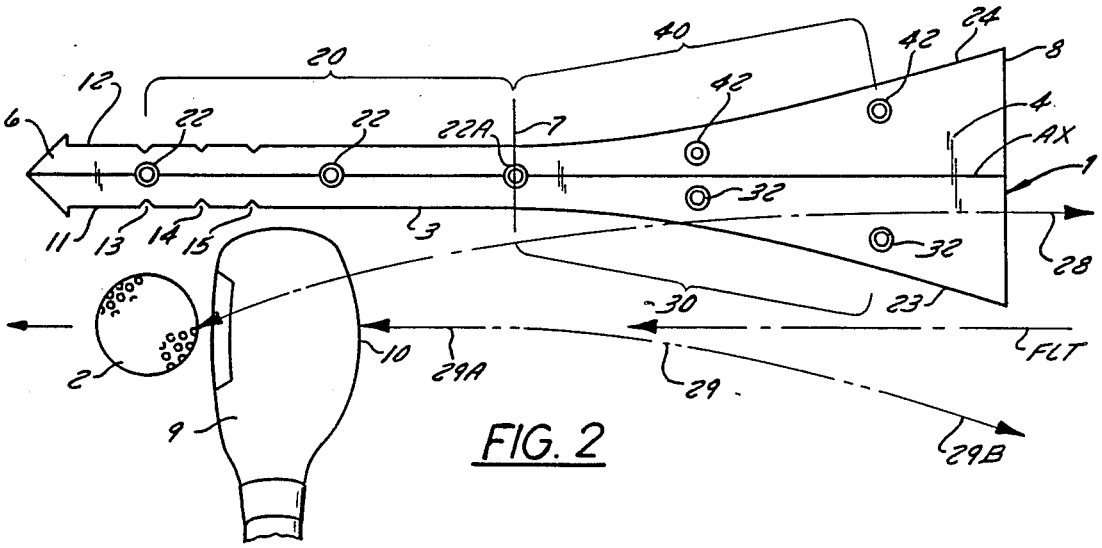
FIG. 2 is a plan view of the device shown in FIG. 1.
Figure 3:
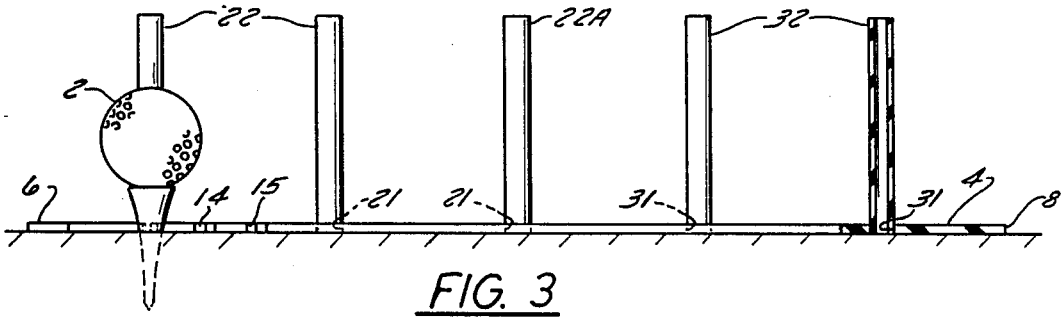
FIG. 3 is a side view of the device shown in FIG. 2.

Referring to FIGS. 1, 2 and 3, the training aid comprises a flat horizontal base member 1 which has a line-of-flight axis AX. The base member 1 includes a narrow forward portion 3 and a fan-shaped rearward portion 4. The term "forward" indicates that portion of the base which is closest to the target for the golf ball 2 when the device is in use and similarly the term "rearward" refers to that portion of the base which is farthest from the target. The forward portion 3 has a front end 6, which may be pointed, and an intermediate interface 7. The rearward portion 4 is preferably integral with the forward portion and extends away from the interface 7 along the line-of-flight axis AX terminating in a back end 8.

The narrow forward portion has spaced apart right and left straight edges 11 and 12 extending parallel to the line-of-flight axis AX and to each other to provide left and right straight horizontal peripheral guide paths extending from front end 6 to the interface 7. Golf ball position indexes 13, 14, 15 are also provided on the forward portion 3 starting adjacent the front end 6. The indexes are spaced apart from each other along the line-of-flight axis AX and may comprise notches cut into edges 11 and 12. In use, the base member should be placed so that the index 13 is located transversely opposite the ball 2 when a driver is to be used, as shown in FIG. 2. Similarly indexes 14 and 15 should be located transversely opposite the ball, respectively, when fairway woods or irons are to be used.

The forward portion 3 has a plurality of apertures 21 extending in a straight line parallel to the line-of-sight axis AX from the front end 6 to the interface 7 to form a straight line set of apertures. Three apertures 21 are shown but more could be provided if desired. A yieldable pylon 22 is removably mounted in each of the apertures 21 to form a straight line set of pylons 20 that constitutes a vertical visual reference barrier extending rearward in a straight line beyond the rear portion 10 of a golf club head 9 when it is in position addressing a golf ball 2 when the device is in use. The pylons 22 may be made from flexible, tubular rubber or plastic stock having a diameter dimensioned to fit snugly in the apertures 21. The third pylon 22A, which is the last pylon of the straight line set 20, is located on the interface 7 and thus also constitutes the first pylon of both the right- and left-hand curved sets of pylons 30 and 40.

The rearward portion 4 has spaced apart right- and left-hand curved edges 23, 24 flaring outward away from each other and the line-of-flight axis AX starting at the interface and extending to the back end 8. The curved edges 23, 24 provide curved peripheral right- and left-hand club head guide path edges that are continuations of the straight peripheral club head guide path edges 11 and 12. The rearward portion 4 also includes a right-hand curved set of spaced apart apertures 31 and a left-hand set of spaced apart apertures 41. The right-hand curved set of apertures 31 extends from the interface 7 along and spaced equidistant from the right-hand curved edge to said back end. Similarly the left-hand curved set of spaced apart apertures 41 extends from the interface 7 along and equidistant from the left-hand curved edge to the back end 8. Yieldable pylons 32 and 42 are removably mounted to extend vertically from the apertures 31 and 41, respectively, to define right- and left-hand curved sets of pylons 30 and 40. The right-hand set 30 of pylons forms a first curved vertical reference barrier alongside of the inside curved swing path edges 23. The left-hand set 40 of pylons forms a second curved vertical reference barrier alongside the inside curved swing path edge 24.

In use the device is set alongside the golf ball 2 to be hit with the front end 6 and the line-of-sight axis AX pointing toward the target. One of the index notches 13, 14 or 15 is set opposite the ball 2 depending upon which type of club is to be used. In FIG. 2, line 28 illustrates an incorrect downswing club head path that crosses the desired line of flight FLT which is parallel to line-of-sight axis AX. Line 29 illustrates the desired straight line club head path 29A which merges smoothly with a curved club head path 29B. The straight line set of pylons 20 is offset from the ball and extends rearwardly from behind the rear face 10 of golf club head 9 to form the first straight vertical visual reference barrier along which the club head toe should track during its initial take-away beginning the backswing. The straight guide edge 11 or 12, depending on whether a right- or left-hand golfer is using the device, forms a straight horizontal visual reference edge alignable with the golf club toe to provide a second straight horizontal visual reference guide for the golfer during initial club head take-away at the beginning of the backswing. Preferably the straight line set 20 of pylons will define a four to six inch straight line take-away path. By causing the club head to follow this straight line take-away, the golfer will naturally be caused to shift his or her weight to the leg rearmost from the target. If the golfer only swings the arms and pivots the body without weight shift, the club head will initially only follow an arcuate not a straight line path during backswing take-away and this incorrect path will be immediately noticeable to the golfer because of the first visual vertical reference guide provided by the straight line set 20 of barrier pylons 22 and the second horizontal visual guide provided by edge 11 or 12.

Similarly after the straight line take-away of the club head along straight path 29A, the club head will follow the correct curved path 29B defined by the right- or left-hand curved vertical visual reference guide provided by the curved set of pylons 30 or 40 and the curved horizontal visual reference guide edge 23 or 24 associated therewith. Thus the golfer is provided with both vertical and horizontal references during the initial phase of the back swing.

Upon execution of the downswing, if the club head follows incorrect path 28 and does not follow the correct inside-straight-inside swing path 29, the club head will hit one or more of the pylons and this contact provides a light tactile pulse in the club shaft without diverting the club head. The pulse signals an incorrect club head swing path. The club head will have traveled outside the line of flight FLT and then come back in across the line-of-flight line. If the correct path 29 is followed, no pylon contact will occur and no pulse will be felt. Thus my invention provides a single training device that will enable both right- and left-hand golfers to perfect both the initial phase of the backswing and the downswing.

The device may be molded all in one piece but if the pylons are made to be removable, a right-hand golfer, for example, may elect to not insert the left-hand curved set of pylons 40. In addition, if the golfer has perfected a correct inside-straight-inside downswing and only desires to work on a straight-inside curved club head take-away at the beginning of the initial phase of the backswing to train for proper weight transfer, both the right- and left-hand curved sets of pylons 30 and 40 may be removed leaving only the straight line set 20.

The disclosed embodiment is by way of example and modifications and changes may be made without departing from the inventive concept.

What is claimed is:

1. A device for training both right- and left-hand golfers to initially move the head of a golf club in a straight line away from a golf ball and then along an inside curved backswing path at the beginning of a backswing, and after completing the backswing, to execute the downswing along an inside-straight swing path relative to an intended line-of-flight for the golf ball comprising:

a horizontal base member having a line-of-flight axis and including, a forward portion having a front end and an intermediate interface, and a rearward portion extending from said intermediate interface and having a back end;

a straight line set of spaced apart, vertically extending, yieldable pylons mounted on said forward portion to extend along a straight line parallel to said line-of-flight axis to said intermediate interface for a distance sufficient to provide a straight line vertical reference barrier that is laterally offset from the ball and extends rearwardly in said straight line from a point laterally offset from the toe of the golf club head placed to address the golf ball when the device is in position for use;

a right-hand curved set of spaced apart, vertically extending, yieldable pylons mounted on said rearward portion starting at said intermediate interface and extending along a curved line that flares smoothly outward away from said line-of-flight axis to said back end to define a first curved vertical reference barrier alongside of said inside curved backswing path for a right-hand golfer; and a left-hand curved set of spaced apart, vertically extending, yieldable pylons mounted on said rear portion starting adjacent said intermediate interface and extending along a curved line that flares smoothly outward from said line-of-flight axis and away from said right-hand set of pylons to said back end to define a second curved vertical reference barrier alongside of said inside curved backswing path for a left-hand golfer.

2. A device according to claim 1 wherein:

a straight line set of apertures is provided in said forward portion spaced apart in a straight line parallel to said line-of-flight axis from adjacent said front end to adjacent said intermediate interface;

a right-hand curved set of apertures is provided in said rearward portion starting adjacent said intermediate interface and spaced apart on said curved line that extends alongside said inside curved backswing path for a right-hand golfer;

a left-hand curved set of apertures is provided in said rearward portion starting adjacent said intermediate interface and extending on said curved line that extends alongside said inside curved backswing path for a left-hand golfer; and said pylons each comprises a yieldable member removably inserted in each of said apertures.

3. A device according to claim 2 wherein:

said forward portion has spaced apart straight edges extending parallel to said line-of-flight axis and to each other from said front end to said intermediate interface; and said rearward portion has a right-hand curved edge flaring smoothly outwardly from said interface aWay from said line-of-flight axis and spaced equidistant from said right-hand set of apertures, and a left-hand curved edge flaring smoothly outwardly from said interface away from said line-of-sight axis and said right-hand edge and spaced equidistant from said left-hand set of apertures.

4. A device according to claim 3 wherein said forward portion has golf ball position indexes starting adjacent said front end and spaced apart from each other along said line-of-flight axis to indicate where the device should be placed relative to the ball depending upon whether a driver, fairway wood, long or short iron is to be used.

5. A device according to claim 4 wherein said front end is pointed.

6. A device for training right- and left-hand golfers to initially move the head of a golf club in a straight line away from a golf ball and then along an inside curved backswing path at the beginning of a backswing and after completing the backswing to execute the downswing along an inside-straight swing path relative to an intended line-of-flight for the golf ball comprising:

a horizontal base member having a line-of-flight axis and including, a forward portion having a front end and an intermediate interface, and a rearward portion integral with said forward portion extending from said intermediate interface, said rearward portion terminating in a back end;

a straight line set of apertures in said forward portion extending from adjacent said front end along a straight line parallel to said line-of-flight axis to said interface to provide a straight line vertical reference barrier that is laterally offset from the ball and extends rearwardly in said straight line from a point laterally offset from the toe of the club head placed to address the golf ball when the device is in position for use;

a right-hand curved set of spaced apart apertures starting at said interface and extending along a curved line that flares smoothly outward away from said line-of-flight to said back end alongside of said inside curved backswing path for a right-hand golfer;

a left-hand curved set of spaced apart apertures starting at said interface and extending along a curved line that flares smoothly outward away from said line-of-flight to said back end alongside of said inside curved backswing path for a left-hand golfer; and a yieldable pylon mounted to extend vertically from each of said apertures in said forward and rearward portions.

7. A device according to claim 6 wherein said yieldable pylons are removably mounted in said apertures.

8. A device adapted to be set alongside a golf ball for training both right- and left-hand golfers to first move the head of a golf club in a straight line away from the golf ball and then along an inside curved backswing path during the initial phase of the backswing and after completing the backswing to execute the downswing along an inside-straight swing path relative to an intended line-of-flight for the golf ball comprising:

a horizontal base member having a line-of-flight axis and including a narrow forward portion and an integral fan-shaped rearward portion terminating in a back end;

said narrow forward portion having a front end and an intermediate interface, spaced apart right- and left-hand straight edges extending from said front end parallel to said line-of-flight and to each other to provide right- and left-hand straight, peripheral, horizontal backswing guide paths extending from said front end to said interface, golf ball position indexes starting adacent said front end and spaced apart from each other along said line-of-flight axis to indicate where the device should be placed relative to the ball depending upon whether a driver, fairway wood, or distance iron is to be used, and a straight line set of apertures extending in a straight line parallel to said line-of-flight axis from said front and to said interface;

said rearward portion having spaced apart right- and left-hand curved edges flaring smoothly outward away from each other and said line-of-flight axis starting at said intermediate interface and extending to said back end to provide curved, peripheral, horizontal right- and left-hand backswing guide paths that are continuous of said straight, peripheral, horizontal backswing guide paths, a right-hand curved set of spaced apart apertures extending from said interface along and spaced equidistant from said right-hand curved edge to said back end, and a left-hand curved set of spaced apart apertures extending from said interface along and spaced equidistant from said left-hand curved edge to said back end; and a yieldable pylon removably mounted to extend vertically from each of said apertures;

said pylons coacting to form a vertical straight line reference barrier laterally offset from and extending rearward in a straight line from the golf club toe, and first and second curved vertical reference barriers for right- and left-hand golfers that are visually alignable by the golfer, when the device is in use, in relation to the golf club toe; and said right- and left-hand straight edges and said right- and left-hand curved edges providing a straight line-curved line horizontal reference path parallel to said vertical reference barrier for both right- and left-hand golfers.

9. A device according to claim 8 wherein one of said apertures of said straight line set of apertures is centered on said interface, and wherein said one aperture constitutes the last aperture of said straight line set of apertures and the first aperture of both said right- and left-hand curved sets of apertures.

* * * * *